US007939764B2

(12) United States Patent
Gottfried et al.

(10) Patent No.: US 7,939,764 B2
(45) Date of Patent: May 10, 2011

(54) FIRE, HEAT AND HIGH VOLTAGE CABLE PROTECTION WRAP

(75) Inventors: Samuel Gottfried, Bronx, NY (US); Peter Harding, New York, NY (US)

(73) Assignee: Samuel Gottfried, Upper Saddle River, NJ (US)

( * ) Notice: Subject to any disclaimer, the term of this patent is extended or adjusted under 35 U.S.C. 154(b) by 637 days.

(21) Appl. No.: 11/903,851

(22) Filed: Sep. 25, 2007

(65) Prior Publication Data

US 2009/0081435 A1 Mar. 26, 2009

(51) Int. Cl.
*H01B 7/00* (2006.01)

(52) U.S. Cl. ..... 174/110 R; 174/120 R; 174/121 A

(58) Field of Classification Search ..... 174/110 R, 174/110 A–110 E, 113 R, 120 R, 121 R, 174/121 A, 122 R; 428/379, 375, 383
See application file for complete search history.

(56) References Cited

U.S. PATENT DOCUMENTS 2,800,524 A * 7/1957 Van Lear ..... 174/116
3,576,388 A * 4/1971 Bruns ..... 174/116
3,576,940 A * 5/1971 Stone et al. ..... 174/113 R
3,823,255 A * 7/1974 La Gase et al. ..... 174/113 R
4,018,962 A * 4/1977 Pedlow ..... 442/138
4,150,249 A * 4/1979 Pedersen ..... 174/36
4,822,659 A * 4/1989 Anderson et al. ..... 428/99
4,965,296 A * 10/1990 Hastings ..... 523/179
5,079,077 A * 1/1992 Sakayanagi et al. ..... 442/212
5,326,604 A * 7/1994 Williamson ..... 428/36.2
6,410,137 B1 * 6/2002 Bunyan ..... 428/356
6,747,214 B2 * 6/2004 Goeblmaier et al. ..... 174/110 R
6,852,412 B2 * 2/2005 Keogh ..... 428/379
6,998,536 B2 * 2/2006 Barusseau et al. ..... 174/110 R
7,304,245 B2 * 12/2007 Alexander et al. ..... 174/110 R
7,378,595 B2 * 5/2008 Brambilla ..... 174/113 R

* cited by examiner

*Primary Examiner* — William H Mayo, III
(74) *Attorney, Agent, or Firm* — Ezra Sutton

(57) ABSTRACT

A fire, heat and high voltage cable wrap system for protecting wires and cables. The protective cable wrap system includes a support layer for strength being selected from the group consisting of woven, non-woven, knitted, netted or matted materials; a high voltage arc resistant layer for protection against high voltage; a fire protective coating layer for protecting the cable wrap system against fire; and a top coating layer for resistance to water, chemicals, gases, environmental factors and mechanical damage. The support layer, the high voltage arc resistant layer, the fire protective coating layer and the top coating layer are laminated together for forming a composite laminate structure having a plurality of concentric layers for the protection of transmission wires, electrical wires and cables that provides for high voltage isolation up to 50 kV.

25 Claims, 3 Drawing Sheets

FIRE, HEAT AND HIGH VOLTAGE CABLE PROTECTION WRAP

FIELD OF THE INVENTION

The present invention relates to a wrap system that provides fire, heat and high voltage protection for cables, especially power distribution cables. It reduces or eliminates fire spread and the emission of smoke and toxic products of combustion. It prevents or reduces spread of cable failure to adjacent cables in the event of a single cable failure due to a fire, insulation breakdown due to heat or arcing, environmental factors or catastrophic cable failure.

BACKGROUND OF THE INVENTION

The grid of electric power distribution in the United States includes main, secondary and tertiary high voltage (high tension) cables installed underground in conduits and ducts, normally accessible by manholes. In a large Metropolitan area, such as New York City, servicing millions of customers, there are numerous cables installed in cable bundles in a particular duct or conduit. Under normal operation, the cable jacket and insulation provides adequate thermal and electrical isolation to prevent arcing (electrical discharge) between cables.

High ambient temperatures and low air circulation in manholes, especially during the summer months, combined with the heat generated by the electric cables, can cause electrical breakdown of cable insulation, arcing and cable fires that rapidly transfer fire and heat to adjacent cables, causing further arcing. The result is a chain reaction that causes multiple cable failures interrupting power to all, or nearly all, cables in a manhole, duct or conduit. Damage spread over a wide area results in power outages to many people, requiring days or weeks to repair and restore service.

Additionally, the high levels of smoke and toxic products of combustion will endanger the lives of many people in adjacent areas, such as subway systems, as well as many individuals attempting to enter the affected areas to service or replace damaged cables.

Current cable wraps provide sufficient high voltage protection under normal conditions, but little, if any, fire and heat protection. Many of these wraps were tested and certified more than thirty years ago based on very low standards of fire protection and no requirements for limitations on smoke or toxic products of combustion. The more recently developed wraps continue to use standards for fire protection that do not adequately model the severe conditions in installations today. Further, they do not provide fire, high voltage and environmental resistance necessary for adequate protection in severe conditions.

There is a need for high performance, intumescent and high voltage wrap to isolate each cable under ordinary conditions and more importantly to provide the necessary isolation for cables in the event of overload, dielectric breakdown, and power surge in intense heat that could otherwise lead to a fire. The wrap isolates a cable failure and power can be switched, either by an operator or automatically by the system, to maintain continuity. Customers serviced by the failed cable, or adjacent cables, experience no disruption of service or only momentary disruption due to a switch over.

Intumescent coatings have been known for many years and have been used to provide thermal protection for many substrates including; wood and wood products, metals, fiberglass, and many types of plastics. However, an intumescent coating applied to these aforementioned substances is impractical for the fire and high voltage protection of electrical cables. Currently there is no single fire and high voltage wrap for electrical cables having all the following features:

1) Providing an effective cable wrap that substantially reduces, or eliminates fire spread along cables and heat transmission to adjacent cables.

2) Provide an effective intumescent fire-retardant coating that substantially reduces, or eliminates, smoke and toxic products of combustion from cable insulation when exposed directly or indirectly to a fire.

3) Provide an effective intumescent fire-retardant coating that is noncombustible and will prevent or eliminate ignition of cable insulation.

4) Provide a cable wrap with superior mechanical properties, including flexibility that allows easy handling, and wrapping of electrical cables of varying diameters.

5) Provide a durable and resistant coating to resist abrasion, impact, water, hydrocarbons, chemicals and other environmental factors associated with underground cable installation.

6) Provide a wrap that has high dielectric breakdown strength providing electrical insulation to 50 kVolts.

7) Provide a wrap that has very low ampacity deration, to maintain the high electric current carrying capacity of the cables.

8) Provide a cable wrap that is easily manufactured for mass production.

DESCRIPTION OF THE PRIOR ART

Intumescent coatings have been known in the prior art for many years and have been used to provide thermal protection for many substances as disclosed by the Hastings U.S. Pat. No. 4,879,320 and by the Gottfried U.S. Pat. No. 5,723,515. The '515 patent discloses a fire resistant material which is applied to a substrate being iron, steel, stainless steel, aluminum, non-ferrous metals, wood, plywood, chipboard, particle board, orientation standard board, plastics, pvc, thermoplastics, epoxies, neoprene, or rubber. The U.S. Pat. No. 5,985,385 to Gottfried discloses a fire and heat protection wrapping system for wrapping conduits, cable trays, transmission lines, cable and other electrical transmission devices associated with the transmission of electricity and electrical signals; and gas and oil pipelines. The protection wrapping system includes a concentric composite laminate structure having a plurality of concentric layers for the protection of the transmission devices which are exposed to high temperatures in excess of three (3) hours in duration. The plurality of concentric layers includes an outer first layer, an inner second layer, an inner third layer and an inner core fourth layer for wrapping the electrical transmission device. The outer first layer is a fiberglass textile having an intumescent coating for resistance to fire, heat, water, impact and outer first layer surrounds the inner second layer.

Further, the inner core fourth layer includes a water jacket layer for absorbing heat. The water jacket layer includes a plurality of elongated and sectionalized compartments with each compartment having a liquid coolant contained therein, and the sectionalized compartments are made from materials selected from the group consisting of plastics, polypropylene, metallized polypropylene, vinyls, polyethyleneterephthalates, metallized polyethyleneterephthalates, high density polyethylene, para-phenyleneterephthalamide.

The wrap systems disclosed by the '515 and the '385 patents by Gottfried do not provide for high voltage insulation, either in normal condition or in the event of dielectric breakdown or arcing, as claimed in the present invention.

Cable wraps known as arc and fireproofing tapes used for more than 30 years by large electrical utilities in the United States, such as Consolidated Edison of New York, comply with the Con Ed EO-5343 Standard. The Standard requires two fire tests; the first test requirement includes a small scale test using a Fisher Bunsen Burner rated at 10,000 BTU/Hr at a flame temperature of 1700 deg F., applied for 6 minutes, and the second requires the exposure to a Bernz-o-matic propane torch for 3 minutes. The surface to be tested is a lead sleeve wrapped with a test specimen cable wrap. There are two acceptance criteria; 1) the tape shall not fall apart, and 2) the sleeve shall not melt. This small-scale test does not adequately model real world conditions and allows very lenient acceptance criteria. It is very substantially less severe than the more widely recognized ANSI/IEEE 383-1974 Standard for cable flame spread measurement, as shown in the comparison table:

| | EO-5343 | ANSI/IEEE 383-1974 |
|---|---|---|
| Exposure heat flux (kW) | 2.5 | 40 |
| Flame temp (deg F) | 1700 | 2000 |
| Exposure time (min) | 6 | 10 |
| Substrate | lead sleeve | actual cable |
| Acceptance criteria | burn-through | electrical conductivity |

The electrical conductivity of a cable is interrupted by a fire long before any burn-through, consequently the ANSI/IEEE 383-1974 Acceptance Criteria represents a far more severe acceptance condition for passage.

Further, the Con Ed EO-5343 fails to measure and limit parameters critical to the protection of installed cables, including; flame spread, ignition, Rate of Heat Release (RHR), smoke development and toxic products of combustion.

The combination of low severity flame tests, lenient acceptance criteria, and absence of measurement of critical parameters allows for approval of many cable wraps in use today that do not provide the necessary protection. Electric Utility problems associated with cable flame spread, ignition, fire damage, smoke, toxicity and widespread power outages continue today. Modest improvements to inadequate current products provide little additional benefit to severe problems. Numerous other types of arc proofing, high voltage, fireproofing or flame retardant wraps for electrical cables have been in use for years. Many of these products are based on composite polymers adhered to a backing material that provides the tape strength. The polymers have intrinsic high dielectric breakdown voltages, with additives that provide some degree of flame retardancy.

Some of these products are based on designs by the Pedlow U.S. Pat. Nos. 4,018,962 and 4,273,821. The tapes are formed using thermoplastics, such as a plastisol or solid plasticized material, with additives such as chlorination, bromination or other flame-retardants such as antimony oxide or zinc tetraborate.

The approval testing for these products for use in current electrical systems were based on very low levels of performance such as the small-scale Bunsen burner tests described above. While these products can surpass these sample tests, they do not nearly provide the high level of fire protection necessary for multiple cables in real world conditions. In addition, these thermoplastics, even with their additives, ignite at relatively low temperatures, have very high rates of combustion, and emit highly toxic products of combustion, many times the lethal levels. Limitations on ignition, heat release rates, smoke and toxic products of combustion were not required as part of the approval process.

Cable and cable tray protection systems have been disclosed by the Licht U.S. Pat. No. 4,433,732 and by the Stahl U.S. Pat. No. RE 32,131. These are panel structures, sometimes reinforced by a steel sheet, including an intumescent or mastic spray on the panel layer.

These types of protection systems are designed mainly for cable trays or boxes, they are labor intensive to install, very heavy, very expensive and do not provide the necessary fire protection.

The U.S. Pat. No. 5,131,064 by Arroyo discloses a sheath system for a cable that protects against lightning strikes. The sheath softens at temperatures in excess of 700 degrees C. (1292 degrees F.) that is substantially lower than temperatures encountered in an ordinary fire (1700-1900 degrees F.). Further, there is no reduction of flame spread along the sheath and no reduction of heat penetration to the cable and wires within the sheath.

The U.S. Pat. No. 6,003,565 to Whittier discloses a woven fiberglass cable wrap system to protect against lightning strikes. There is no protection against flame spread or heat protection.

The U.S. Pat. No. 5,851,663 to Parsons discloses a flame retardant pressure sensitive tape that meets the small-scale criteria of UL94. This is a very low level of flame-spread reduction, using a Bunsen burner type of exposure. When tested according to UL510 even at low exposure of 50 kw/sqm, Parson's tape exhibits only modest reduction of Rate of Heat Release (RHR) and very high levels of CO emission. At higher and more realistic exposure levels of 100-150 kw/sqm, these tapes would provide no protection. The fire performance is very nominal, and there is no high voltage or arc protection.

The Lausch U.S. Pat. No. 6,236,791 and the Zarian U.S. Pat. No. 6,363,197 disclose fire retardant and/or self-extinguishing optical fiber cables composed of composites, such as polypropylene, with flame retardant additives. The flame retardancy is very minimal, and does not even pass small flame tests, as disclosed in the patents. Additionally, these products emit high levels of toxic products combustion as measured by NES 713.

The U.S. Pat. No. 6,797,200 to Scelza discloses a self-extinguishing cable and fire retardant composition using extruded insulation on copper conductors. The fire retardancy is very nominal, passing only small-scale Bunsen burner tests at 1 kW exposure. As mentioned previously, these tests do not model the severe fire exposure of cables in real world situations.

When tested according to IEC 332/3, the cables burned for 1.3 m. While this is technically a passing grade (2 m is failure) it does not provide the fire protection necessary for severe, real world exposures. Further, there is no protection to heat penetration to the cable core.

The U.S. Pat. No. 6,852,412 to Keogh discloses a cable wrap with an intumescent coating on a support layer of fiberglass or paper in the preferred embodiment. In an alternate embodiment, the cable wrap has an additional support layer of a ceramic material, such as mica, foamed polyolefin resin selected from polyethylene, polypropylene copolymer. The preferred embodiment of Keogh has been disclosed in prior art to the Hastings '320 patent and to the Gottfried '515 patent. The intumescent coating on a support layer does not provide the cable protection required, including insufficient heat penetration protection, water and chemical resistance, abrasion protection of high voltage and arc protection.

Additionally, the use of material such as fiberglass is prohibited by electric companies due to the potential hazard to installers. In the Keogh '412 alternate embodiment, with addition of a layer such as mica, there is additional rigidity, cost and toxic by products of combustion. Further, there is no high voltage and arc protection.

None of the aforementioned prior art references disclose a fire, heat, high voltage and environmental protection cable wrap system that eliminates or substantially reduces fire and flame spread along the length of a cable or cable bundle.

Accordingly, it is an object of the present invention to provide a fire and high voltage cable wrap system that eliminates or substantially reduces fire and flame spread along the length of a cable or cable bundle.

Another object of the present invention is to provide a fire and high voltage cable wrap system that eliminates fire, heat and thermal transmission to adjacent cables in a manhole, duct or conduit.

Another object of the present invention is to provide a fire and high voltage cable wrap system that provides high voltage (high tension) isolation to 50,000 volts (50 kV).

Another object of the present invention is to provide a fire and high voltage cable wrap system that has very low ampacity deration, which does not affect the current carrying capacities of the wrapped cables.

Another object of the present invention is to provide a fire and high voltage cable wrap system that does not adversely affect installation techniques of current cable wraps or require any retraining of installers.

Another object of the present invention is to provide a fire and high voltage cable wrap system that is thin, lightweight, and flexible and does not require modification of cable wrapping techniques.

Another object of the present invention is to provide a fire and high voltage cable wrap system that is easily fabricated in a manufacture process, and does not substantially alter the appearance of ordinary cable wraps.

Another object of the present invention is to provide a fire and high voltage cable wrap system that is mechanically strong, very flexible and easy to install.

Another object of the present invention is to provide a fire and high voltage cable wrap system that it is very durable and resistant to abrasion, impact, water, chemicals and all environmental factors that may be present in cable installations underground or in conduits or ducts.

Another object of the present invention is to provide a fire and high voltage cable wrap system that substantially reduces, or eliminates, smoke and toxic products of combustion of cable insulation or ordinary cable wraps, when exposed directly, or indirectly, to a fire.

Another object of the present invention is to provide a fire and high voltage cable wrap system that is free from asbestos, halogens, solvents or other toxic or environmentally unfriendly composition.

Another object of the present invention is to provide a fire and high voltage cable wrap system that can be mass-produced in an automated and economical manner and is cost efficient for application by many users.

Another object of the present invention is to provide a fire protective coating that does not support combustion, and is noncombustible according to ISO 1182.

Another object of the present invention is to provide a fire protective coating that has zero or near zero Rate of Heat Release (RHR) when exposed to radiant heat up to 150 kw/sqm.

Another object of the present invention is to provide a fire protective coating and cable wrap system that when directly or indirectly exposed to fire or heat emits zero or near zero smoke or toxic products of combustion Another object of the present invention is to provide coatings that are easy to apply and cure in a manufacturing process that can easily be mass-produced on a large scale.

Another object of the present invention is to provide a fire, heat and high voltage cable wrap system that is cost effective for application to all high voltage (high tension) cables installed.

Another object of the present invention is to provide a cable wrap system that can be used to upgrade existing cable wraps that currently have little or no fire and heat protection, in a very economical manner.

A further object of the present invention is to provide a fire and high voltage cable wrap system that can be mass-produced in an automated and economical manner and is readily affordable by the contractor or user.

SUMMARY OF THE INVENTION

In accordance with the present invention, there is provided a fire, heat and high voltage cable wrap system for protecting wires and cables. The protective cable wrap system includes a support layer for strength being selected from the group consisting of woven, non-woven, knitted, netted or matted materials; a high voltage arc resistant layer for protection against high voltage; a fire protective coating layer for protecting the cable wrap system against fire; and a top coating layer for resistance to water, chemicals, gases, environmental factors and mechanical damage. The support layer, the high voltage arc resistant layer, the fire protective coating layer and the top coating layer are laminated together for forming a composite laminate structure having a plurality of concentric layers for the protection of transmission wires, electrical wires and cables that provides for high voltage isolation up to 50 kV.

BRIEF DESCRIPTION OF THE DRAWINGS

Further objects, features and advantages of the present invention will become apparent upon the consideration of the following detailed description of the presently preferred embodiment when taken in conjunction with the accompanying drawings, wherein.

DETAILED DESCRIPTION OF THE PREFERRED EMBODIMENT 10

Figure 1:
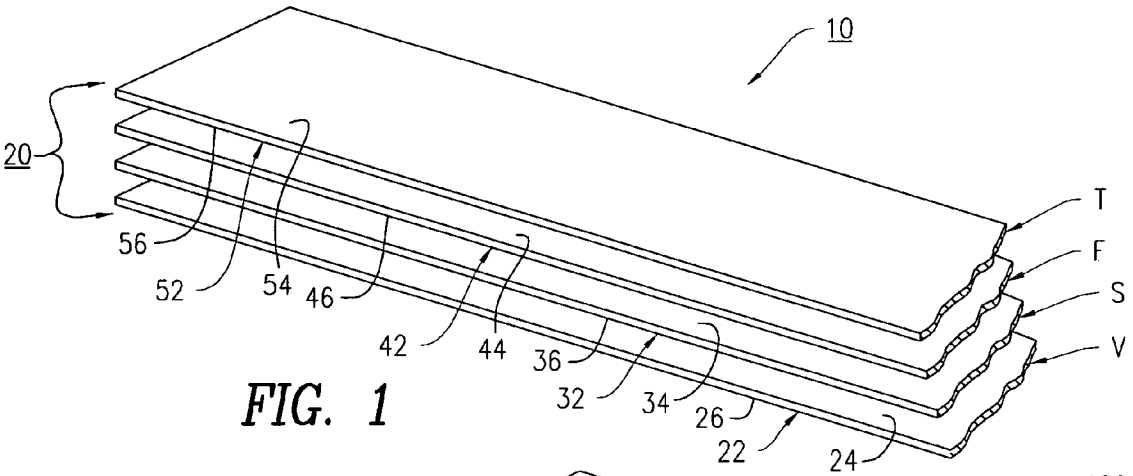
FIG. 1 is an exploded perspective view of the cable protection wrap system of the preferred embodiment of the present invention showing a high voltage insulation layer, a support layer, a fire and heat protective coating layer and a top coating layer for forming the cable protection wrap.
Figure 4:
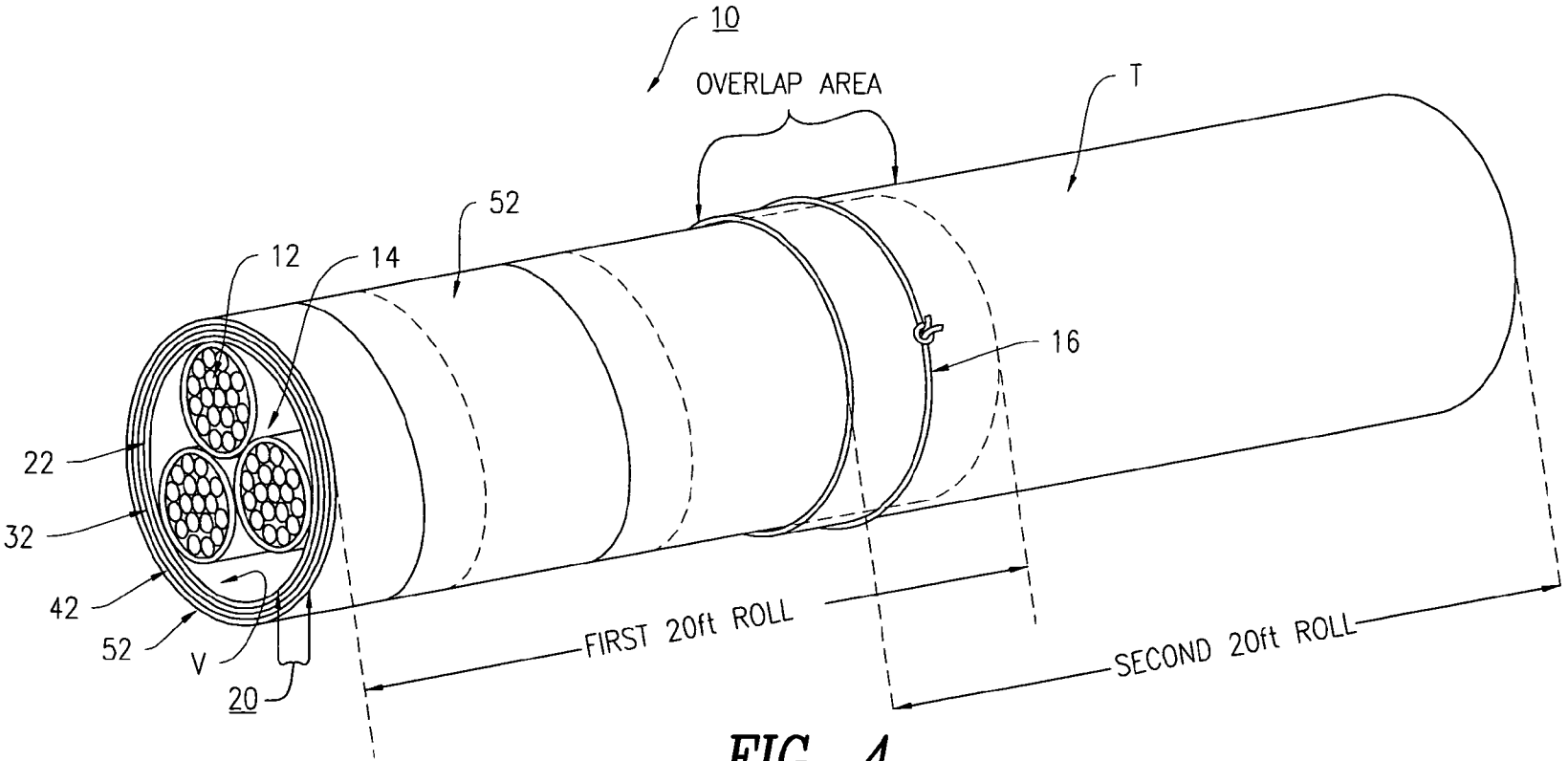
FIG. 4 is a perspective view of the protection cable wrap system of the preferred embodiment of the present invention showing the cable wrap having four (4) layers wrapped around three (3) electrical cables in an assembled state and in an operational mode thereof.

The fire, heat and high voltage cable protection wrap system 10 and its component layers of the preferred embodiment of the present invention is represented in detail by FIGS. 1 and 4 of the patent drawings. The cable protection wrap system 10 provides for fire, heat and high voltage protection for cables 12, especially power distribution cables. The cable protection wrap system 10 includes a concentric composite laminate structure 20 having a plurality of laminate layers 22, 32, 42 and 52 for reducing and/or eliminating fire spread, and the emission of smoke and toxic products, and the laminate structure 20 prevents or reduces spread of cable failure to adjacent cables in the event of a single cable failure due to a fire, or insulation breakdown due to heat or arcing, environmental factors or catastrophic cable failure.

As shown in FIGS. 1 and 4, the four (4) ply concentric laminate structure includes an inner first layer 22 having a first surface 24 and a second surface 26 for high voltage insulation V; an inner second layer 32 having a first surface 34 and a second surface 36 for providing structural support and strength S for cable wrap system 10; an inner third layer 42 having a first surface 44 and a second surface 46 for providing fire and heat insulation F; and an outer fourth layer 52 having a first surface 54 and a second surface 56 for providing a protective topcoat outer layer T that provides durability and resistance to environmental factors such as heat, water, wind, cold, chemicals and gases, to the cable wrap system 10.

The high voltage first inner layer 22 is a high dielectric strength, arc resistant layer made from thermoset resins, acrylic resins, silicone resins, polyvinylchloride, polyvinylidene flouride, plastisols and the like. The second inner layer 32 is a support layer S selected from woven or non-woven, knitted, netted, or matted materials such as polyester, nylon, fiberglass, Nextel, Nomex, aramid fibers, carbonized acrylic fibers, metallic strands, cellulose or polyester films and the like. The third inner layer 42 is a fire protective coating layer F such as an intumescent, fire protective coating, fire retardant coating and the like. The outer fourth layer 52 is a topcoat layer T for durability and resistance to environmental factors such as water, chemicals, gases, and comprised of material such as epoxy, polyurethane, acrylics, alkyds, enamels, elastomerics, polyesters and the like.

The concentric composite laminate structure 20 is assembled in the following manner: The first surface 24 of the high voltage arc resistant insulation layer 22 is adjacent to and in contact with the second surface 36 of the support layer 32. The first surface 34 of the support layer 32 is adjacent to and in contact with the second surface 46 of the fire and heat insulation and protective coating layer 42; the first surface 44 of the fire and heat insulation and protective coating layer 42 is adjacent to and in contact with second surface 56 of the protective topcoat layer 52, as shown in FIG. 1 of the drawings, which when laminated by heat and pressure forms the concentric composite laminated structure 20 of cable wrap system 10. Each of the layers 22, 32, 42 and 52 have a thickness in the range of 0.001" to 0.100", and a preferred range for thickness of 0.020" to 0.050" for the high voltage arc resistant insulation layer V, a preferred range for thickness of 0.005" to 0.015" for the support and strength layer S, a preferred range of for thickness 0.005" to 0.020" for the fire and heat insulation layer F and a preferred range for thickness of 0.002" to 0.006" for the topcoat outer layer T.

EXAMPLES OF USE FOR THE CABLE WRAP SYSTEM 10

Example 1

The cable wrap system 10 as disclosed in claim 1 is constructed as follows:

1) High voltage arc resistant layer 22 is comprised of W.R. Grace Quelpyre Resin, approximately 0.040" coating thickness.

2) Woven structural layer 32 is polyester having a thickness of 0.010"

3) Fire protection layer 42 is NoFire A18, manufactured by NoFire Technologies.

4) Topcoat environmental layer 52 is an elastomeric, acrylic coating.

The cable wrap system 10 is used to wrap a three-cable bundle 14 of high voltage cables 12 similar to the ones used by the Distribution Section of Consolidated Edison of New York (Con Ed) (See FIG. 4). The wrapped bundle is installed in a vertical burn apparatus similar to the type used to conduct ANSI/IEEE 383 Fire Tests. Test setup, test conditions, exposure, time and acceptance criteria are specified by the Standard.

Results of ANSI/IEEE 383 Fire Test:

1) No cable ignition or fire involvement for duration of the test (10 minutes).

2) Flame travel (spread) near zero for duration.

3) No smoke visible for duration.

4) No fire or flame after test termination.

Example 2

The cable wrap system 10 of Example #1 is tested according to ASTM E162 for flame spread, smoke generation and ignition potential. The results of this test are: FSI—0, SDI—10, no ignition.

Example #3

The cable wrap of Example #1 is tested according to ASTM E662 for smoke emission and toxic products of combustion using the Drager Tube Method, according to BSS 7239 Gas Analysis.

Results of smoke emission are:

| | Flaming | Non-Flaming |
|---|---|---|
| Ds @ 90 sec | 0 | 1 |
| Ds @ 4 min | 10 | 3.5 |
| Dm | 24 | 24 |

Results of Gas Analysis (in parts per million):

| Gas (type): | Non Flaming | Flaming |
|---|---|---|
| Hydrochloric Acid (HCL) | 0 | 0 |
| Hydro cyanic Acid (HCN) | 0 | 0 |
| Hydrogen Fluoride (HF) | 0 | 0 |
| Nitrous Fumes (NO + NO2) | 2.5 | 5 |
| Carbon Monoxide (CO) | 7.5 | 27.5 |
| Sulfur Dioxide (SO2) | 0 | 0 |
| Phosgene (CL2CO) | 0 | 0 |

Example #4

The cable wrap system 10 of Example #1 is tested according to ASTM E1354, Cone Calorimeter, at radiant heat flux 25, 50 kw/sqm. The emitted heat flux densities for both exposures are zero.

Method of Making Cable Wrap System 10

The protection cable wrap system 10 is formed in the following manner using a curing process: The first processing step 210 of process 200 starts with a roll A of the support layer S material 32, wherein the second surface 36 of the support layer 32 is applied with a high voltage insulation layer 22 of liquid resin-material V using applicator knife processor K, where the high voltage insulation layer 22 is cured in a first oven $O_1$ at a temperature range of 120° F. to 150° F. for a time period $P_1$ in the range of 3 to 8 minutes.

In the next step, processing step 220, the cured high voltage insulation layer 22 and support layer 32 are then applied with a fire resistant intumescent coating material F, wherein the first surface 34 of the support layer 32 is applied with a liquid intumescent material F, using a coating bath $B_1$. Then the fire and heat intumescent insulation layer 42 is cured and set in a second oven $O_2$ at a temperature range of 110° F. to 180° F. for a curing time period $P_2$ in the range of 2 to 5 minutes.

In the last processing step 230, the cured and set high voltage insulation layer 22, the support layer 32 and the intumescent insulation layer 42 are now applied with a liquid topcoat material T, wherein the first surface 44 of the intumescent insulation layer 42 is also applied by a coating bath $B_2$ of the liquid top coating material T, such that the top coating environmental layer 52 is cured and set in a third oven $O_3$ at a temperature range 100° F. to 140° F. for a curing time period $P_3$ in the range of 1 to 3 minutes. In step 240, the cured protection cable wrap 10 is wrapped on a spool Sp for shipment to the manufacturer of wrapped conduits 12.

Detailed Description of the First Alternate Embodiment 100

Figure 2:
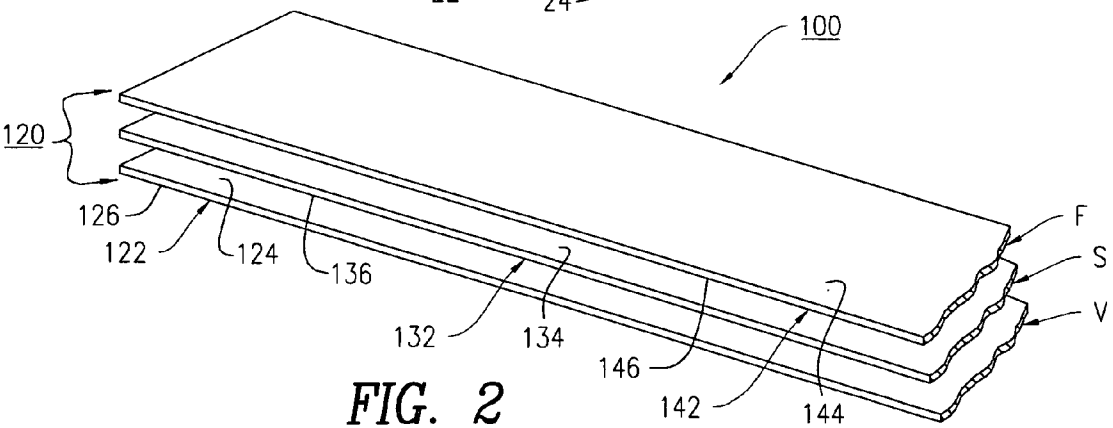
FIG. 2 is an exploded perspective view of the cable protection wrap system of the first alternate embodiment of the present invention showing the high voltage arc resistant insulation layer, the support layer and the fire and heat protective coating layer for forming the first alternate embodiment of the cable protection wrap.
Figure 3:
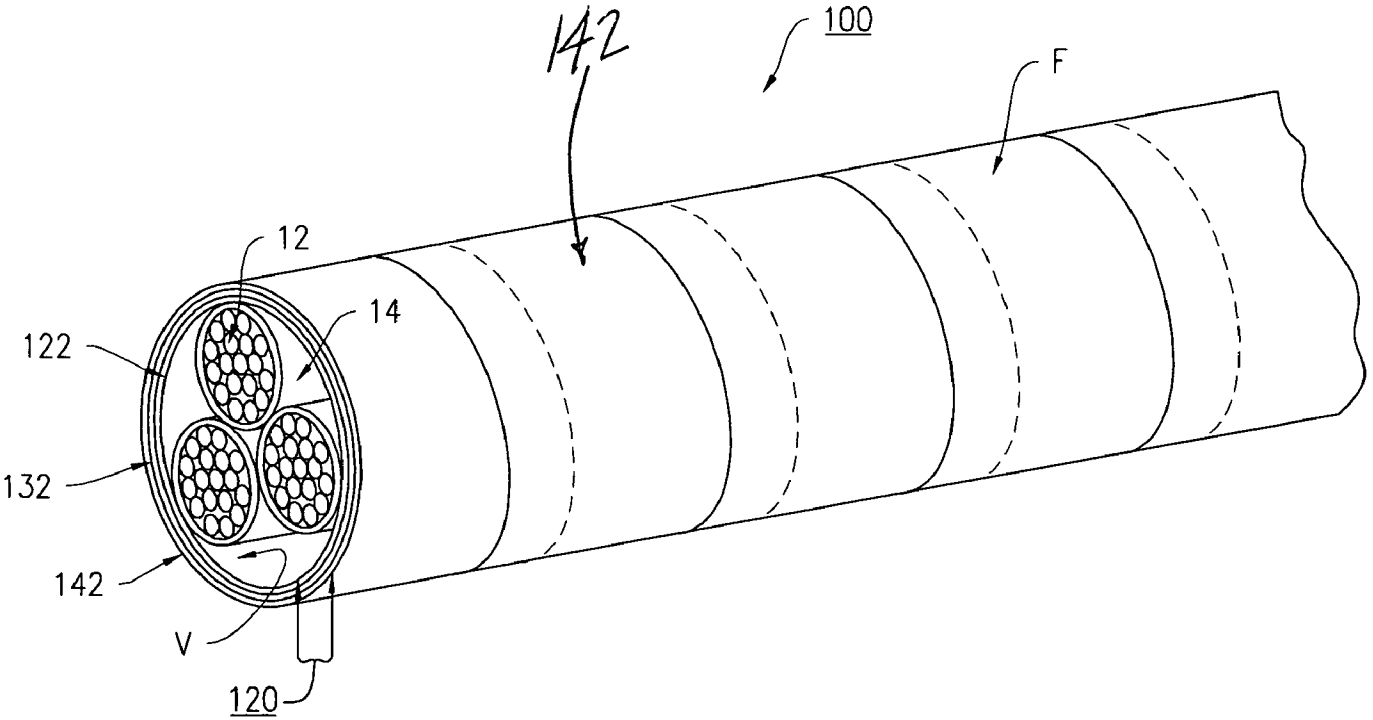
FIG. 3 is a perspective view of the protection cable wrap system of the first alternate embodiment of the present invention showing the cable wrap having three (3) layers wrapped around three (3) electrical cables in an assembled state and in an operational mode thereof.

The fire, heat and high voltage cable protection wrap system 100 and its component layers of the first alternate embodiment of the present invention is represented in detail by FIGS. 2 and 3 of the patent drawings. The cable protection wrap system 100 also provides for fire, heat and high voltage in the protection of cables 12 for the transmission of electricity above ground and cables installed underground in conduits and ducts (not shown). The cable protection wrap system 100 includes a concentric composite laminate structure 120 having a plurality of laminate layers 122, 132 and 142 for reducing and/or eliminating fire spread, and the emission of smoke and toxic products such that it prevents or reduces spread of cable failure to adjacent cables in the event of a single cable failure due to a fire or insulation breakdown due to heat or arcing, environmental factors or catastrophic cable failure.

As shown in FIGS. 2 and 3, the three (3) ply concentric laminate structure 120 includes an inner first layer 122 having a first surface 124 and a second surface 126 for high voltage insulation V; an inner second layer 132 having a first surface 134 and a second surface 136 for providing structural support and strength S for cable wrap system 100; and an outer third layer 142 having a first surface 144 and a second surface 146 for providing fire and heat insulation F.

The high voltage first inner layer 122 is a high dielectric strength, arc resistant layer made from thermoset resins, acrylic resins, silicone resins, PVC, PVDF, plastisols and the like. The second inner layer 132 is a support layer, selected from woven or non-woven, knitted, netted or matted materials such as polyester, nylon, fiberglass, Nextel, Nomex, aramid fibers, carbonized acrylic fibers, metallic strands, cellulose or polyester films and the like. The outer third layer 142 is a fire protective layer such as an intumescent, fire protective coating, fire retardant coating and the like.

OPERATION OF THE PRESENT INVENTION

The Fire, Heat and High Voltage Cable Wrap systems 10 and 100 of the present inventions are used to wrap individual cables 12, cable bundles 14 and conduits in an identical procedure to current cable and cable bundle wrapping techniques. A wrapped cable bundle is shown in FIG. 3 such that the cable wrap system 100 is installed using a half-lap technique, where each composite laminate structure 120 is half covered by the next succeeding composite laminate structure 120 (see FIG. 3). A typical size for a roll of the cable wrap system 10 is 3 inches wide by 20 feet long. After each roll is installed on a cable bundle 14, a steel or fiberglass tie wire 16 is used to tie the ends before continuing with the next roll, as shown in FIG. 4 of the drawings.

ADVANTAGES OF THE PRESENT INVENTION

Accordingly, an advantage of the present invention is that it provides for a fire and high voltage cable wrap system that eliminates or substantially reduces fire and flame spread along the length of a cable or cable bundle.

Another advantage of the present invention is that it provides for a fire and high voltage cable wrap system that eliminates fire, heat and thermal transmission to adjacent cables in a manhole, duct or conduit.

Another advantage of the present invention is that it provides for a fire and high voltage cable wrap system that provides high voltage (high tension) isolation to 50,000 volts (50 kV).

Another advantage of the present invention is that it provides for a fire and high voltage cable wrap system that has very low ampacity deration, which does not affect the current carrying capacities of the wrapped cables.

Another advantage of the present invention is that it provides for a fire and high voltage cable wrap system that does not adversely affect installation techniques of current cable wraps or require any retraining of installers.

Another advantage of the present invention is that it provides for a fire and high voltage cable wrap system that is thin, lightweight, and flexible and does not require modification of cable wrapping techniques.

Another advantage of the present invention is that it provides for a fire and high voltage cable wrap system that is easily fabricated in a manufacture process, and does not substantially alter the appearance of ordinary cable wraps.

Another advantage of the present invention is that it provides for a fire and high voltage cable wrap system that is mechanically strong, very flexible and easy to install.

Another advantage of the present invention is that it provides for a fire and high voltage cable wrap system that it is very durable and resistant to abrasion, impact, water, chemicals and all environmental factors that may be present in cable installations underground or in conduits or ducts.

Another advantage of the present invention is that it provides for a fire and high voltage cable wrap system that substantially reduces, or eliminates, smoke and toxic products of combustion of cable insulation or ordinary cable wraps, when exposed directly, or indirectly, to a fire.

Another advantage of the present invention is that it provides for a fire and high voltage cable wrap system that is free from asbestos, halogens, solvents or other toxic or environmentally unfriendly composition.

Another advantage of the present invention is that it provides for a fire and high voltage cable wrap system that can be mass-produced in an automated and economical manner and is cost efficient for application by many users.

Another advantage of the present invention is that it provides for a fire protective coating that does not support combustion, and is noncombustible according to ISO 1182.

Another advantage of the present invention is that it provides for a fire protective coating that has zero or near zero Rate of Heat Release (RHR) when exposed to radiant heat up to 150 kw/sqm.

Another advantage of the present invention is that it provides for a fire protective coating and cable wrap system that when directly or indirectly exposed to fire or heat emits zero or near zero smoke or toxic products of combustion Another advantage of the present invention is that it provides for coatings that are easy to apply and cure in a manufacturing process that can easily be mass-produced on a large scale.

Another advantage of the present invention is that it provides for a fire, heat and high voltage cable wrap system that is cost effective for application to all high voltage (high tension) cables installed.

Another advantage of the present invention is that it provides for a cable wrap system that can be used to upgrade existing cable wraps that currently have little or no fire and heat protection, in a very economical manner.

A further advantage of the present invention is that it provides for a fire and high voltage cable wrap system that can be mass-produced in an automated and economical manner and is readily affordable by the contractor or user.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A fire, heat and high voltage flexible cable wrap system that is lightweight for protecting wires and cables having a plurality of concentric layers forming a composite laminate structure, comprising:

a) a support layer for strength being selected from the group consisting of woven, non-woven, knitted, netted or matted materials;

b) a high voltage arc resistant layer for protection against high voltage wherein said cable wrap provides high voltage isolation in a range of 8 kV to 20 kV;

c) an intumescent fire protective coating layer for protecting said cable wrap system against fire;

d) a top coating layer for resistance to water, chemicals, gases, environmental factors and mechanical damage; and e) said support layer, said high voltage arc resistant layer, said fire protective coating layer and said top coating layer are laminated together forming a flexible, lightweight composite laminate wrap having a plurality of concentric layers for the protection of transmission wires, electrical wires and cables that provides for high voltage isolation.

2. A fire, heat and high voltage cable wrap system for protecting wires and cables in accordance with claim 1, wherein said high voltage arc resistant layer is made from materials that are selected from the group consisting of thermoset resins, acrylic resins, silicone resins, polyvinylchloride, polyvinylidene fluoride, plastisols and combinations thereof.

3. A fire, heat and high voltage cable wrap system for protecting wires and cables in accordance with claim 1, wherein said support layer materials for strength are selected from the group consisting of polyester, nylon, fiberglass, Nextel, nomex, aramid fibers, carbon fibers, carbonized acrylic fibers, metallic strands, cellulose or polyester films such as cellophane or mylar and combinations thereof.

4. A fire, heat and high voltage cable wrap system for protecting wires and cables in accordance with claim 1, wherein said fire protective coating layer for fire protection includes materials selected from the group consisting of, solvent intumescents, epoxy intumescents, fire retardant coatings and combinations thereof.

5. A fire, heat and high voltage cable wrap system for protecting wires and cables in accordance with claim 1, wherein said top coating layer includes materials selected from the group consisting of epoxies, polyurethanes, acrylics, alkyds, enamels, elastomerics, polyesters, mylars and combinations thereof.

6. A fire, heat and high voltage cable wrap system for protecting wires and cables in accordance with claim 1, wherein said cable wrap provides high voltage insulation in a range of 4 kV to 50 kV.

7. A fire, heat and high voltage cable wrap system for protecting wires and cables in accordance with claim 1, wherein said cable wrap system can be used to upgrade current high voltage wraps that have insufficient fire protection.

8. A fire, heat and high voltage cable wrap system for protecting wires and cables in accordance with claim 1, wherein each of said layers has a thickness in the range of 0.005 to 0.100.

9. A fire, heat and high voltage cable wrap system for protecting wires and cables in accordance with claim 1, wherein said support layer for strength has a thickness in the preferred range of 0.004" to 0.015".

10. A fire, heat and high voltage cable wrap system for protecting wires and cables in accordance with claim 1, wherein said high voltage arc resistance layer has a thickness in the preferred range of 0.020" to 0.050".

11. A fire, heat and high voltage cable wrap system for protecting wires and cables in accordance with claim 1, wherein said fire protective coating layer has a thickness in the preferred range of 0.005" to 0.020".

12. A fire, heat and high voltage cable wrap system for protecting wires and cables in accordance with claim 1, wherein said top coating layer for resistance has a thickness in the preferred range of 0.002" to 0.006".

13. A fire, heat and high voltage cable wrap system for protecting wires and cables in accordance with claim 1, wherein each of said layers of said cable wrap system are interchangeable.

14. A fire, heat and high voltage cable wrap system for protecting wires and cables in accordance with claim 1, wherein said cable wrap system complies with the flexibility, durability and environmental resistance standards of Con Ed Specification EO-5343.

15. A fire, heat and high voltage cable wrap system for protecting wires and cables in accordance with claim 1, wherein said fire protective layer is a noncombustible layer according to ISO 1182 standard.

16. A fire, heat and high voltage cable wrap system for protecting wires and cables in accordance with claim 1, wherein said cable wrap system has an ampacity deration of less than 10%.

17. A fire, heat and high voltage cable wrap system for protecting wires and cables in accordance with claim 1, wherein said fire protective layer has a low flame spread according to ASTM E84, ASTM E162, IMO A.653 standards.

18. A fire, heat and high voltage cable wrap system for protecting wires and cables in accordance with claim 1, wherein said fire protective coating layer has low smoke and low toxic products of combustion when tested according to the ASTM E662 standard, and the BSS 7239 standard.

19. A fire, heat and high voltage cable wrap system for protecting wires and cables in accordance with claim 1, wherein said cable wrap system is lightweight, weighing less than 2 lbs. for a 3"×20' roll.

20. A fire, heat and high voltage cable wrap system for protecting wires and cables in accordance with claim 1, wherein said high voltage arc insulation layer is cured in an oven at a temperature range of 120° F. to 150° F. for a curing time period range of 3 to 8 minutes.

21. A fire, heat and high voltage cable wrap system for protecting wires and cables in accordance with claim 1, wherein said fire protective coating layer is cured in an oven at a temperature range of 110° F. to 180° F. for a curing time period range of 2 to 5 minutes.

22. A fire, heat and high voltage cable wrap system for protecting wires and cables in accordance with claim 1, wherein said top coating layer is cured in an oven at a temperature range of 100° F. to 140° F. for a curing time period range of 1 to 3 minutes.

23. A fire, heat and high voltage flexible cable wrap system that is lightweight for protecting wires and cables having a plurality of concentric layers forming a composite laminate structure, comprising:

a) a support layer selected from woven or non-woven knitted, netted, or matted materials selected from the group consisting of polyester, nylon, fiberglass, Nextel, nomex, aramid fibers, carbonized acrylic fibers, metallic strands, cellulose or polyester films such as cellophane or mylar, or combinations thereof;

b) a high voltage arc resistant layer made from the group consisting of thermoset resins, acrylic resins, silicone resins, polyvinylchloride, polyvinylidene flouride, plastisols, or combinations thereof wherein said cable wrap provides high voltage isolation in a range of 8 kV to 20 kV;

c) an intumescent fire protective coating layer;

d) a top coating layer for resistance to water, chemicals, gases, environmental factors and mechanical damage made from materials selected from the group consisting of epoxy, polyurethane, acrylics, alkyds, enamels, elastomerics, polyesters, or combinations thereof; and e) said support layer, said high voltage arc resistant layer, said fire protective coating layer and said top coating layer forming a flexible, lightweight composite laminate layer wrap having a plurality of concentric layers for the protection of transmission wires, electrical wires and cables that provides for high voltage isolation.

24. A fire, heat and high voltage flexible cable wrap system that is lightweight for protecting wires and cables having a plurality of concentric layers forming a composite laminate structure, comprising:

a) a support layer selected from woven or non-woven knitted, netted, or matted materials selected from the group consisting of polyester, nylon, fiberglass, Nextel, nomex, aramid fibers, carbonized acrylic fibers, metallic strands, cellulose or polyester films such as cellophane or mylar, or combinations thereof;

b) a high voltage arc resistant layer made from materials selected from the group consisting of thermoset resins, acrylic resins, silicone resins, polyvinylchloride, polyvinylidene fluoride, plastisols or combinations thereof wherein said cable wrap provides high voltage isolation in a range of 8 kV to 20 kV;

c) an intumescent fire protective coating layer; and d) said support layer, said high voltage arc resistant layer, and said fire protective coating layer forming a flexible, lightweight composite laminate layer wrap having a plurality of concentric layers for the protection of transmission wires, electrical wires and cables that provides for high voltage isolation.

25. A fire, heat and high voltage flexible cable wrap system that is lightweight for protecting wires and cables having a plurality of concentric layers forming a composite laminate structure comprising:

a) a high voltage arc resistant layer made from the group consisting of thermoset resins, acrylic resins, silicone resins, polyvinylchloride, polyvinylidene fluoride, plastisols or combinations thereof wherein said cable wrap provides high voltage isolation in a range of 8 kV to 20 kV;

b) an intumescent fire protective coating layer;

c) a top coating layer for resistance to water, chemicals, gases, environmental factors and mechanical damage made from the group consisting of epoxy, polyurethane, acrylics, alkyds, enamels, elastomerics, polyesters or combinations thereof; and d) said high voltage arc resistant layer, said fire protective coating layer and said top coating layer forming a flexible, lightweight composite laminate layer wrap having a plurality of concentric layers for the protection of transmission wires, electrical wires and cables that provides for high voltage isolation.

* * * * *